US008443520B2

(12) United States Patent
Viereck et al.

(10) Patent No.: US 8,443,520 B2
(45) Date of Patent: May 21, 2013

(54) DEVICE FOR STRIPPING SHEATHING ON UNBONDED POST-TENSIONING TENDONS

(76) Inventors: Kyle Viereck, Spring, TX (US); Russell L. Price, Magnolia, TX (US)

( * ) Notice: Subject to any disclaimer, the term of this patent is extended or adjusted under 35 U.S.C. 154(b) by 469 days.

(21) Appl. No.: 12/584,649

(22) Filed: Sep. 9, 2009

(65) Prior Publication Data

US 2010/0071528 A1 Mar. 25, 2010

Related U.S. Application Data

(60) Provisional application No. 61/191,455, filed on Sep. 9, 2008.

(51) Int. Cl.
*B21F 13/00* (2006.01)
*B26B 27/00* (2006.01)

(52) U.S. Cl.
USPC ..... 30/90.1

(58) Field of Classification Search
USPC ..... 30/90.1–91.2
See application file for complete search history.

(56) References Cited

U.S. PATENT DOCUMENTS

| | | | | | |
|---|---|---|---|---|---|
| 2,187,215 | A | * | 1/1940 | Spinello | 30/90.6 |
| 3,628,402 | A | * | 12/1971 | Staiger | 81/9.44 |
| 3,686,982 | A | * | 8/1972 | Bull | 30/91.2 |
| 4,117,749 | A | * | 10/1978 | Economu | 30/90.6 |
| 4,426,778 | A | * | 1/1984 | Christie | 30/90.1 |
| 4,459,881 | A | * | 7/1984 | Hughes, Jr. | 30/90.1 |
| 4,543,717 | A | * | 10/1985 | Luka | 30/90.6 |
| 4,689,882 | A | * | 9/1987 | Lorenz | 30/90.1 |
| 4,729,268 | A | * | 3/1988 | Morrow | 30/90.1 |
| 4,731,928 | A | * | 3/1988 | Jackson | 30/90.2 |
| 5,577,150 | A | * | 11/1996 | Holder et al. | 30/90.4 |
| 5,632,088 | A | | 5/1997 | Naso et al. | |
| 5,745,996 | A | | 5/1998 | Kenny et al. | |
| 5,749,270 | A | * | 5/1998 | Bourbeau | 30/90.4 |
| 6,023,844 | A | * | 2/2000 | Hinson et al. | 30/90.8 |
| 6,098,290 | A | | 8/2000 | Sorkin | |
| 6,108,910 | A | | 8/2000 | Sorkin | |
| D430,474 | S | * | 9/2000 | Lawler | D8/98 |
| 6,247,235 | B1 | * | 6/2001 | Lawler | 30/90.4 |
| 6,381,850 | B1 | * | 5/2002 | Warner | 30/90.6 |
| 6,510,610 | B2 | * | 1/2003 | Losinger | 30/90.2 |
| 6,530,152 | B1 | * | 3/2003 | Christensen et al. | 30/90.1 |
| 6,725,533 | B1 | * | 4/2004 | Losinger | 30/90.1 |
| 6,935,030 | B2 | * | 8/2005 | Loik | 30/90.1 |
| 7,243,429 | B2 | * | 7/2007 | Landes et al. | 30/90.4 |
| 2003/0115759 | A1 | * | 6/2003 | Loik | 30/90.1 |
| 2004/0221456 | A1 | * | 11/2004 | Losinger | 30/90.2 |
| 2005/0115074 | A1 | * | 6/2005 | Gialenios et al. | 30/90.1 |

* cited by examiner

*Primary Examiner* — Jason Daniel Prone
(74) *Attorney, Agent, or Firm* — Ober, Kaler, Grimes & Shriver; Royal W. Craig

(57) ABSTRACT

A device for helically cutting and automatically removing waste sheathing from the stressing tails of unbonded tendons. The device comprises an elongated body and an attached cutting head. Both the body and the cutting head have a uniform through bore along their longitudinal axis for accepting a post-tensioned tendon. The cutting head comprises an integral blade having a cutting face radially offset from the longitudinal axis and inclined at a pitch angle of between 45 and 85 degrees relative to the longitudinal axis. The blade cuts the sheathing while also ejecting the waste sheathing.

4 Claims, 4 Drawing Sheets

Step 1: Remove pocket former and ring cut tendon sheathing at edge of concrete.

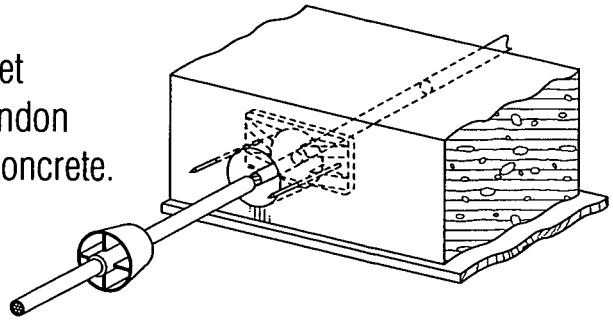

Step 2: Remove tendon sheathing from stressing tail and slide Suncoast FSC™ over the end of the tendon.

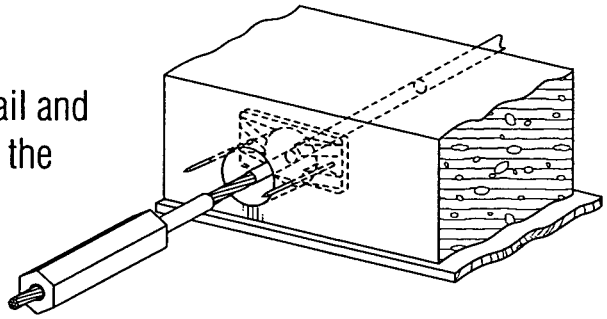

Step 3: Rotate Suncoast FSC™ clockwise pushing against the end of sheathing until FSC™ is against the face of the anchor.

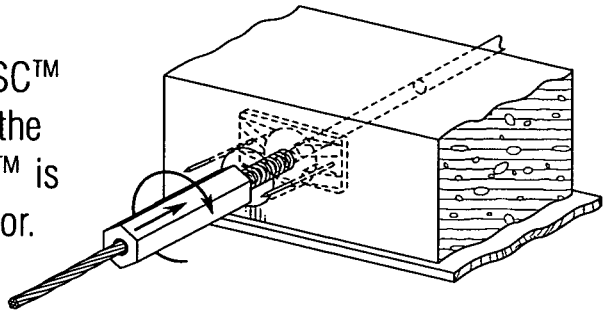

Step 4: Remove the sheathing "slinky" from the anchor cavity to ensure it is clean, and insert wedges.

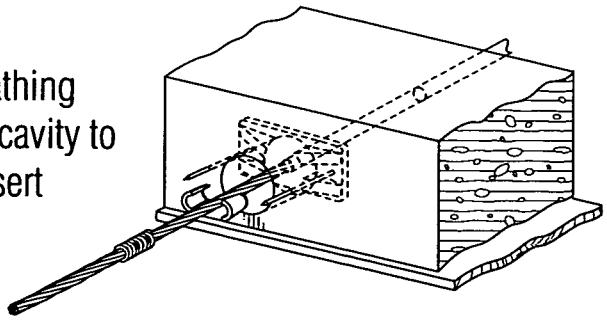

Fig. 6

DEVICE FOR STRIPPING SHEATHING ON UNBONDED POST-TENSIONING TENDONS

CROSS-REFERENCE TO RELATED APPLICATIONS

The present application derives priority from U.S. Provisional Patent Application No. 61/191,455 filed on Sep. 9, 2008, which is incorporated herein by reference.

BACKGROUND OF THE INVENTION

1. Field of the Invention

The present invention relates generally to a post-tensioning tendon sheathing stripper for use in concrete structures utilizing unbonded post-tensioning systems and, more specifically, to a device for removing the plastic sheathing from the stressing end of tendons.

2. Description of the Background

Post-tensioning concrete entails the use of high-strength steel strand, "tendons," that are embedded in concrete and tensioned after the concrete hardens. Using tendons under tension creates cast-in-place and precast concrete members that have superior strength characteristics when compared to similarly sized non-prestressed members. In unbonded post-tensioning applications, the steel tendons are first encased in a plastic sheathing before being laid into concrete forms. Most tendons have a fixed anchor on one end that is attached to the tendon in a manufacturing facility and that butts up against the concrete form. The other end of the tendon, also known as the "stressing tail," is passed loosely through a stressing anchor that is affixed to the other end of the concrete form and then extends a fixed distance past the form. After the concrete is placed, cured, and hardened to a specified strength, a hydraulic jack is attached to the stressing tail to apply tension to the tendon.

The stressing anchor has a tapered pocket into which wedges are placed. The wedges grip the tendon and lock it in place to maintain the tension during the lifespan of the concrete member.

The tendons are encased in a plastic sheathing to protect it from corrosion and to allow the tendon's steel strand portion to move within the concrete member while being tensioned to evenly distribute the tension along the entire tendon. For maximum durability, the sheathing should cover the complete length of the tendon and not be too short; however, the sheathing cannot extend inside of the stressing anchor's wedge pocket because it would impede the clamping ability of the anchor wedges.

There are two ways to ensure that the sheathing is the proper length. The first way is to place the sheathed tendon in its eventual position by laying the stressing tail over the stressing anchor and form. The sheathing is then "ring-cut" at the back of the stressing anchor and slid six to twelve inches away from the ring cut and then slid through the stressing anchor. Construction code requires that the tendon sheathing protrude into the transition sleeve on the back of the stressing anchor at least four inches. At this point, the concrete can be placed and cured, the form can be removed, and the tendon can be tensioned. Repair to the sheathing is necessary if a four inch overlap is not achieved during installation. This repair process comprises making a ring-cut 18 to 24 inches from the end of the anchor sleeve and sliding the sheathing into the anchor sleeve, leaving a one-inch gap. A smaller piece of sheathing can then be slit and installed in the tendon's gap with two layers of waterproof tape.

However, if the sheathing is not ring-cut prior to placing the concrete, the sheathing on the stressing tail must be stripped away from the tendon all the way down to the bottom of the stressing anchor wedge pocket. The present device addresses this situation. There have been a few attempts at developing a device that strips away excess tendon sheathing after the concrete has been placed; however, these existing devices have shortcomings.

U.S. Pat. No. 6,108,910, issued on Aug. 29, 2000, to Sorkin discloses a device and method for stripping the plastic sheathing from a tendon. This device comprises a cylindrical tool body attached to a narrow cutter head on one end designed to fit within the tapered pocket of a stressing anchor. A U-shaped channel runs longitudinally through the tool body and cutter head, and a blade is mounted via a set screw at an acute transverse angle of between 70 and 89 degrees on the cutter head. The channel allows the tool to be placed over the tendon rather than threaded along the tendon. The device is slid into the tapered pocket of the stressing anchor until the blade engages with the sheathing and is then rotated. When the tool is rotated, the blade angle causes a "drawing inward" effect until the tool abuts the anchor, and a ring cut is produced at the stressing anchor end of the excess sheathing. At this point the blade cuts transversely through the sheathing, and the waste sheathing can be removed. Unfortunately, the '910 device does not fully spiral cut or remove the excess sheathing, and as a result, the excess sheathing must be removed either by un-threading the sheathing off the tendon or by using a separate knife to slice the waste sheathing longitudinally before removing it from the tendon. Additionally, the use of a stamped steel blade with this device would require frequent blade changes, and the U-shaped design complicates the hand rotation.

U.S. Pat. No. 6,098,290, issued on Aug. 8, 2000, to Sorkin, discloses a device and method for stripping a tendon similar to the device disclosed by the '910 patent, except that the '290 patent incorporates specific features such as a ribbed, compressible tool body that when squeezed grabs the waste sheathing and a removable locking blade of a particular design. Unfortunately, as with the '910 device, the '290 device does not fully spiral cut or remove the excess sheathing, and as a result, the excess sheathing must be removed either by unthreading the sheathing off the tendon or by using a separate knife to slice the sheathing longitudinally before removing it. Additionally, the blade used in this device dulls quickly and must be changed often, and the compressible tool body, combined with the U-shaped design, may make the device difficult to rotate by hand.

U.S. Pat. No. 5,632,088, issued on May 27, 1997, to Naso et al., discloses a tendon stripper device. This device comprises a cylindrical tool body with one tapered end designed to fit within the tapered pocket of a stressing anchor. A cylindrical passage runs longitudinally through the tool body, and an inwardly projecting blade is mounted in a channel in the tapered end at a transverse angle. The blade is mounted on a movable lever such that insertion of the device into a stressing anchor causes the blade to engage the sheathing. Upon engagement, force (such as with a hammer) is then applied to the non-tapered end of the device, causing the blade to "plow" through the sheathing until the blade abuts the bottom of the stressing anchor. Upon full engagement, the device is rotated to cut the sheathing. The waste sheathing can then be removed. Unfortunately, the '088 device requires hammering to become fully engaged, and if the device is not fully engaged, sheathing will remain in the area to be occupied by the anchor wedges causing a sub-optimal locking of the tendon. Additionally, the waste sheathing must be removed either by unthreading the sheathing off the end of the tendon or by using a separate knife to longitudinally slice the sheathing before removing it.

U.S. Pat. No. 5,745,996, issued on May 5, 1998, to Kenny et al., discloses a sheathing cutting device. This device comprises a cylindrical tool body with one tapered end designed to fit within the tapered pocket of a stressing anchor. A U-shaped channel runs longitudinally through the tapered end, and a box-shaped channel runs longitudinally through the rest of the body. An inwardly projecting blade is mounted in a channel in the tapered end at a transverse angle utilizing a spring mechanism. The blade is mounted on a movable lever such that at rest, the blade is retracted within the tapered end of the body, and insertion of the tapered end of the device into a stressing anchor causes the blade to project into the sheathing with the blade being at full projection upon full insertion of the device into a stressing anchor. Once the blade initially contacts the sheathing, force (such as with a hammer) is then applied to the non-tapered end of the device, causing the knife to "plow" through the sheathing as it continues to project until the blade abuts the bottom of the stressing anchor and is fully projected. Upon full projection of the blade and engagement of the device, the device is rotated to cut the sheathing. The waste sheathing can then be removed. Unfortunately, the '996 device requires hammering to become fully engaged, and if the device is not fully engaged, the sheathing will not be fully cut. This result makes removing the sheathing difficult and causes sub-optimal locking of the tendon in the area to be occupied by the anchor wedges. Additionally, the waste sheathing must be removed either by threading the sheathing off the end of the tendon, or by using a separate knife to longitudinally slice the waste sheathing before removal. Finally, the U-channel design may make the device difficult to rotate by hand.

SUMMARY OF THE INVENTION

It is, therefore, a primary objective of the present invention to provide a device for cutting and removing sheathing from a sheathed post-tensioning tendon. The device comprising a tubular body of uniform diameter removably or fixedly attached to a tubular cutting head. The cutting head sized to fit within the wedge pocket of a stressing anchor. The tubular body and cutting head define a uniform through bore along their common longitudinal axis through which the steel tendon is inserted. The cutting head has a blade at its distal end that is with a cutting face radially offset from the longitudinal axis and inclined at a pitch angle of between 45 and 85 degrees relative to the longitudinal axis that cuts a helical path through the entire waste sheathing as the handle is turned about the tendon. The blade is angled to draw the tool forward along the tendon as it cuts the sheathing, advancing into the stressing anchor wedge pocket, and automatically ejecting the waste sheathing.

Upon the blade reaching the bottom of the stressing anchor wedge pocket, the blade cuts the sheathing flush with the bottom of the stressing anchor wedge pocket in a single rotation, and the spiral waste sheathing easily falls away. Alternatively, the device may include handles or wrench flats to easily rotate the device around a tendon or may include a body of the same diameter as the cutting head. Alternatively, the device may include a "stop" attached to the cylindrical cutting head that prevents the blade from coming in direct contact with the bottom of the stressing anchor wedge pocket thereby dulling it prematurely.

One advantage of this device over previous spiral cut devices such as the '910 device and the '290 device is that a heavier, stronger blade configuration is used that does not require replacing as frequently. Another advantage is that entire length of the waste sheathing is cut, and the waste sheathing is automatically removed without the requirement of a separate waste sheathing removal step. One advantage of this device over the previous "plowing" devices such as the '088 device and the '996 device is that the helical engagement of the blade with the sheathing results in a clean cut of the waste sheathing flush with the bottom of the stressing anchor wedge pocket without the need for hammering. More advantages include the ease in accurately setting the device and that the entire length of the waste sheathing is cut and automatically removed without the requirement of a separate waste sheathing removal step. One advantage that this device has over all of the aforementioned devices is that the simplicity of the current device allows it to be produced in a more economical manner, and yet the device is more robust and less prone to breakdown or replacement.

BRIEF DESCRIPTION OF THE DRAWINGS

Other objects, features, and advantages of the present invention will become more apparent from the following detailed description of the preferred embodiments and certain modifications thereof when taken together with the accompanying drawings in which:

FIG. 6 illustrates a method of the present invention for removing the sheathing after placing the concrete.

DETAILED DESCRIPTION OF THE PREFERRED EMBODIMENT

The present invention is a device for cutting and removing sheathing from a sheathed tendon during the post-tensioning process. In an embodiment, the device comprises a tubular body of uniform diameter attached to a tubular cutting head. The cutting head has a smaller diameter and is concentric with the tubular body. The cutting head is sized to fit within the wedge pocket of an anchor collar or "stressing anchor." The body and cutting head have a through bore along their common longitudinal axis. The cutting head has a blade protruding radially from the distal edge, the blade having a planar cutting face radially offset from the tendon and angled at a pitch angle between 45 and 85 degrees from the longitudinal axis of the body. In use, the device is slipped over the stressing tail of the tendon until the cutting head engages with the sheathing to be cut. As the body is rotated causing the cutting head to turn about the tendon, the blade cuts a helical path through the entire waste sheathing. This blade angle causes the device to be drawn forward into the anchor pocket and forward along the tendon as it cuts the sheathing until it touches the bottom of the stressing anchor wedge pocket, while simultaneously and automatically ejecting the resultant waste sheathing as the blade advances. Upon the blade engaging the bottom of the stressing anchor wedge pocket, the angle of the blade relative to the longitudinal axis of the body causes the blade to sit snugly against the bottom of the stressing anchor wedge pocket as it rotates around the tendon, cleanly cutting the sheathing flush with the bottom of the stressing anchor wedge pocket.

Figure 1:
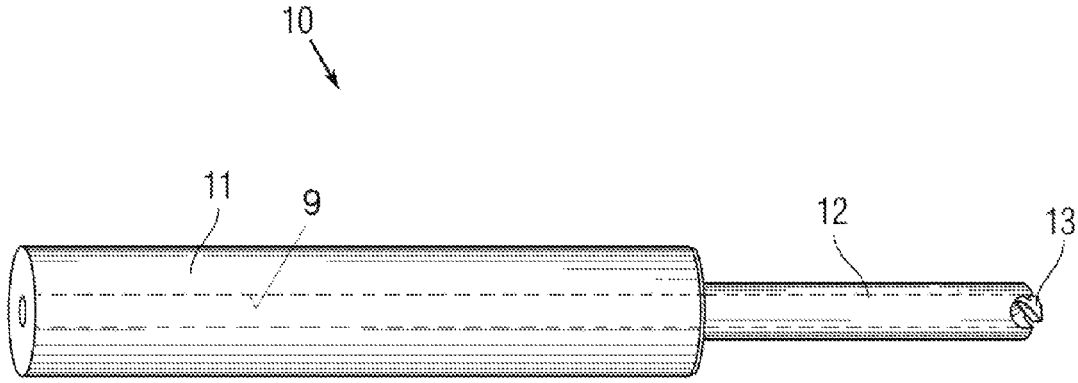
FIG. 1 is a side view of an embodiment of the present invention.

FIG. 1 shows an embodiment of the device 10 for the stripping post-tension tendon sheathing. Device 10 has an elongated tubular body 11 of consistent diameter. One end of the body 11 is removably or fixedly attached to a tubular cutting head 12 of a consistent diameter. The cutting head 12 may have a different outer diameter than that of the body 11. The body 11 may be fixedly attached to the cutting head 12, for example, via welding or similar attachment or may be integrally formed. Alternatively, the body 11 may be removably attached to the cutting head 12, for example, by threading the cutting head 12 into the body 11 or through some alternate means of attachment. The cutting head 12 is concentric with the body 11 along their longitudinal axes.

The cutting head 12 and body 11 have a through bore 9 along their entire common longitudinal axis. In an embodiment, the outside diameter of the cutting head 12 is smaller than that of the body 11 to allow the cutting head 12 to fit inside any type of stressing anchor wedge pocket, whereas the body's outer diameter facilitates a sturdy hand grip. The distal end of the cutting head 12 is formed with an integral protruding blade 13 having a planar cutting face 14 radially offset from the longitudinal axis and inclined at a pitch angle $\alpha$ of between 45 and 85 degrees relative to the longitudinal axis, the cutting face 14 leading to a cutting edge 15 that extends substantially radially with respect to the longitudinal axis of the device 10.

In an embodiment, the body 11 comprises a material suited to withstand all applied forces, both axial and bending, such as steel or a rigid thermoplastic. The diameter of the through bore of the body 11 should be sufficient to allow the device 10 to be slid over the stressing tail of the tendon to be stripped. Using a through bore rather than a U-shaped channel, as discussed above, minimizes the "play" between the device 10 and the tendon.

Figure 2:
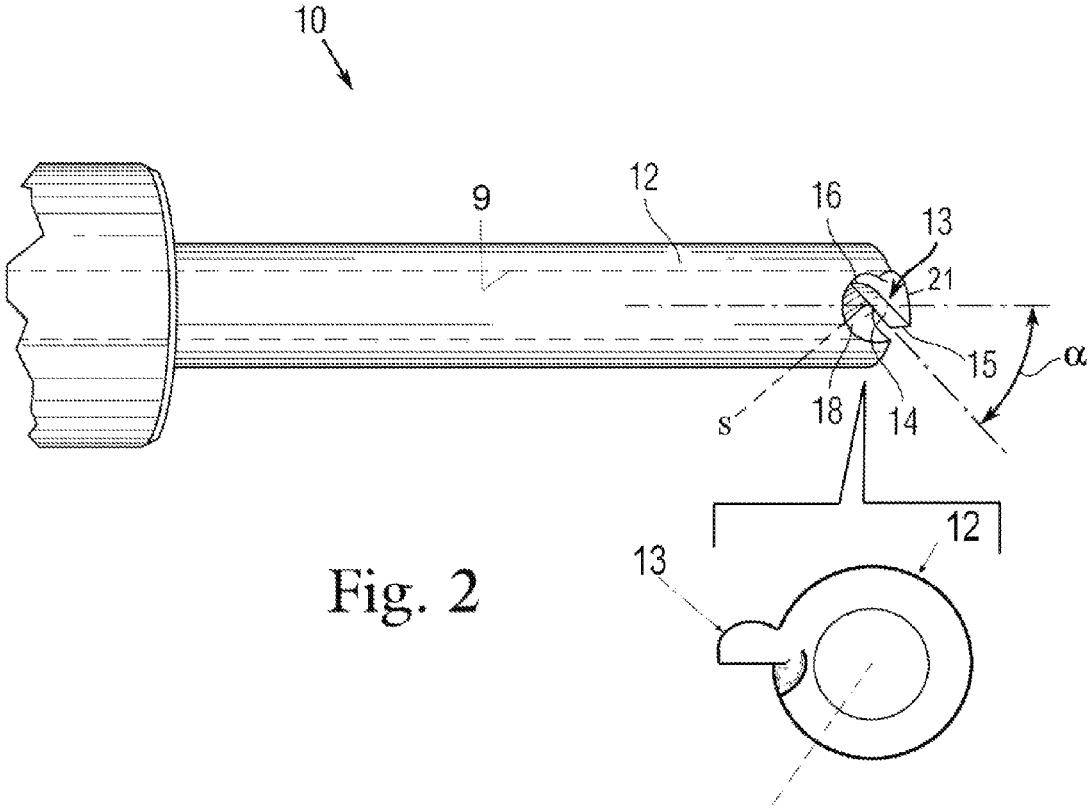
FIG. 2 is an enlarged side view of an embodiment of the present invention showing the cutting head and blade with inset end view.

FIG. 2 shows an enlarged side view of the cutting head 12 and blade 13 of the device 10 highlighting the cutting face 14, leading edge 15, and trailing edge 16. The leading edge 15 is approximately radial with the longitudinal axis of the cutting head 12. The angle $\alpha$ between the plane of the blade's cutting face 14 (from leading edge 15 to trailing edge 16) and the longitudinal axis of the cutting head is between 45 and 85 degrees. This angling causes the device 10 to be drawn into the stressing anchor wedge pocket as it is rotated around the stressing tail of the tendon. This angling also causes the waste sheathing to be stripped away in a helical ribbon. As can be seen from FIG. 2, the leading edge 15 of the cutting face 14 is on the distal edge of the cutting head 12.

The distal end of the cutting head 12 may be cut at an angle with the plane of the cut relative to the longitudinal axis of the cutting head 12 being between 10 and 90 degrees and with the forward-most edge of the cut coinciding with the leading edge 15 of the blade 13.

The diameter of the cutting head's bore is sized to allow the cutting head 12 to slide easily over the stressing tail of the tendon, but not so large as to allow play between the cutting head 12 and the stressing tail of the tendon or to allow the device 10 to pass over the sheathing to be stripped. The diameter of the cutting head's bore must be small enough to force the blade 13 to fully engage the sheathing when the device 10 is slid over the stressing tail of the tendon and, upon rotation of the device 10, to maintain the blade 13 against the waste sheathing to cut through its entire thickness and ultimately strip it away in a helical ribbon. The outer diameter of the cutting head 12 cannot exceed the smallest inner diameter of the stressing anchor pocket used in conjunction with the tendon to be stripped.

In an embodiment, the cutting head 12 comprises a strong and durable material such as steel or a rigid thermoplastic. The blade 13 can be integrally formed by machining the distal end of the cutting head 12. The distal end of cutting head 12 is cut along a secant passing through two points radially spaced apart at approximately 20 degrees on the peripheral surface. The cut originates at the first point and terminates within 2-5 millimeters of the second point, rendering an integral hanging "fingernail" suspended above a crescent notch 18. The fingernail is then cold-formed by bending the hanging fingernail up and then turning its distal edge inward to define the cutting face 14 on the blade 13. The cutting face 14 is radially offset from and oriented transverse to the longitudinal axis of the head 12. The blade 13 is formed at defined by a pitch angle a between the plane of the blade's cutting face 14 (which extends from the leading cutting edge 15 to the trailing edge 16) and the longitudinal axis of the cutting head 12. The cutting face 14 is then sharpened with a beveled cutting edge 15. The blade 13, possibly including the distal end of the cutting head 12 or the entire cutting head 12, is preferably hardened to increase service life for the device. Note that the truncated distal end of the cutting head 12 defines an annular face, and the radially offset blade 13 protrudes beyond the outside diameter of the cutting head 12, presenting an offset outer and leading cutting edge 15, and an offset backside 21 of the blade 13 which serves as a "stop" to halt insertion of the blade within the anchor, thereby preventing and since the cutting edge 15 bevel is inside the cutting face 14 this avoids the cutting edge of the blade 13 from biting into from coming into direct contact with the bottom of the stressing anchor wedge pocket. This particular machined-blade 13 configuration results in a much more durable device 10 and a longer service lifetime. The tool is suitable for use with any sort of stressing anchor.

Figure 3:
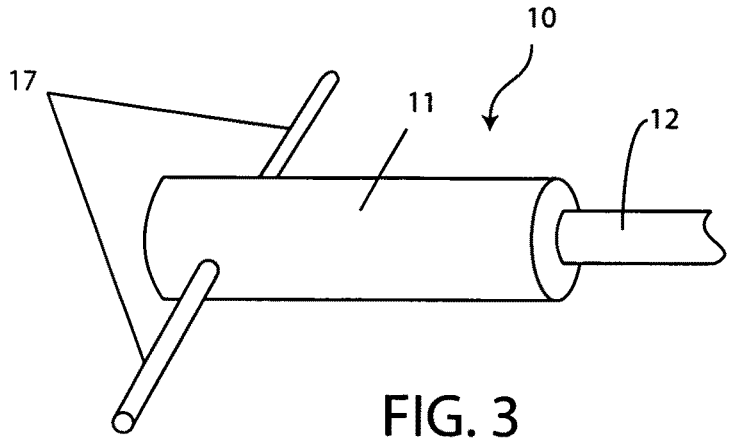
FIG. 3 is a perspective view of an alternative embodiment of the invention including handles.
Figure 4:
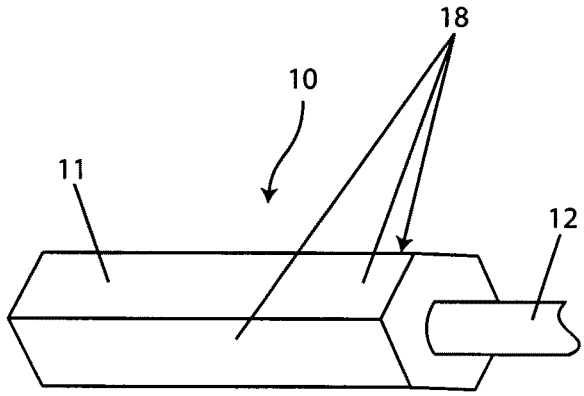
FIG. 4 is a perspective view of an alternative embodiment of the invention including wrench flats.
Figure 5:
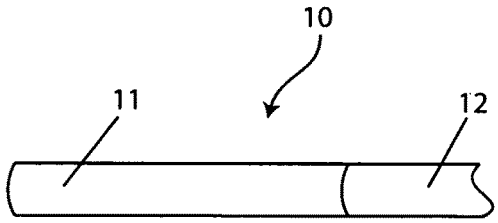
FIG. 5 is a perspective view of an alternate embodiment of the invention where the body and cutting head have the same diameter.

FIGS. 3, 4, and 5 illustrate alternative embodiments of the device 10. The body 11 may comprise additional features to aid in gripping and rotating the body around the tendon while stripping the waste sheathing from the tendon's stressing tail. Specifically, FIG. 3 shows a perspective view of an alternative embodiment of the device 10 including two cylindrical handles 17 projecting radially from the surface of the body 11. There may be one or more handles, and the handles may be configured as cylindrical handles as shown in FIG. 3 or as "U-shaped" handles where the sides of the "U" are radial to the surface of the body, and the bottom of the "U" is parallel to the surface of the body. The addition of handles 17 facilitates rotation of the device 10 about a tendon while stripping waste sheathing from the tendon's stressing tail and provides an alternative means of carrying the invention. Alternatively, the surface of the body 11 may be knurled or otherwise textured, or may be coated in a rubberized or similar material. These embodiments facilitate rotation of the device 10 about a tendon while stripping waste sheathing from the tendon's stressing tail.

FIG. 4 shows a perspective view of an alternative embodiment of the device 10 including wrench flats. In the illustrated embodiment, the body 11 is hexagonal having 3 pairs of parallel flat surfaces 19 running longitudinally along the body's surface. The addition of parallel flat surfaces 18 facilitates rotation of the device 10 about a tendon by allowing the use of a wrench to assist in rotation and by providing additional grip should it be rotated by hand. Any polygonal shape may be used. FIG. 5 shows a perspective view of an alternative embodiment of the invention in which the body 11 and cutting head 12 have the same outside diameter.

FIG. 6 shows an exemplary embodiment of a method for using the device 10 for stripping sheathing after the concrete has been placed, including the following steps: step 1, removing the stressing anchor pocket former and pre-cut tendon sheathing from the stressing tail of the tendon at the edge of the formed concrete; step 2, sliding the device 10 over the stressing tail of the tendon until the tool blade 13 engages the tendon sheathing inside the stressing anchor wedge pocket; step 3, rotating the device 10 while keeping the device in contact with the sheathing so that the rotation of the device, in combination with the engagement of the blade 13 with the sheathing, causes the blade to spirally cut the sheathing along the tendon and towards the bottom of the stressing anchor wedge pocket, whereupon reaching the bottom, the device 10 makes a ring-cut in the sheathing flush with the stressing anchor wedge pocket bottom; and step 4, removing the tool and spirally cut waste sheathing from the tendon and inserting wedges to set the tension. As illustrated in FIG. 6, when the device 10 is in position to remove the sheathing, the tendon passes through the device 10 along the device's longitudinal axis. Once the blade 13 engages the sheathing, the device 10 only needs to be rotated and does not require pressure upon the device 10 in the direction of the stressing anchor wedge pocket bottom because the angle $\alpha$ of the blade 13 pulls the device 10 along the tendon as it is rotated. In an alternative embodiment, a "stop" located along the edge of the blade's leading edge 15 will engage with the bottom of the stressing anchor wedge pocket to avoid wear and tear on the blade 13 that would otherwise be caused by the blade 13 directly engaging with the bottom of the stressing anchor wedge pocket.

Figure 7:
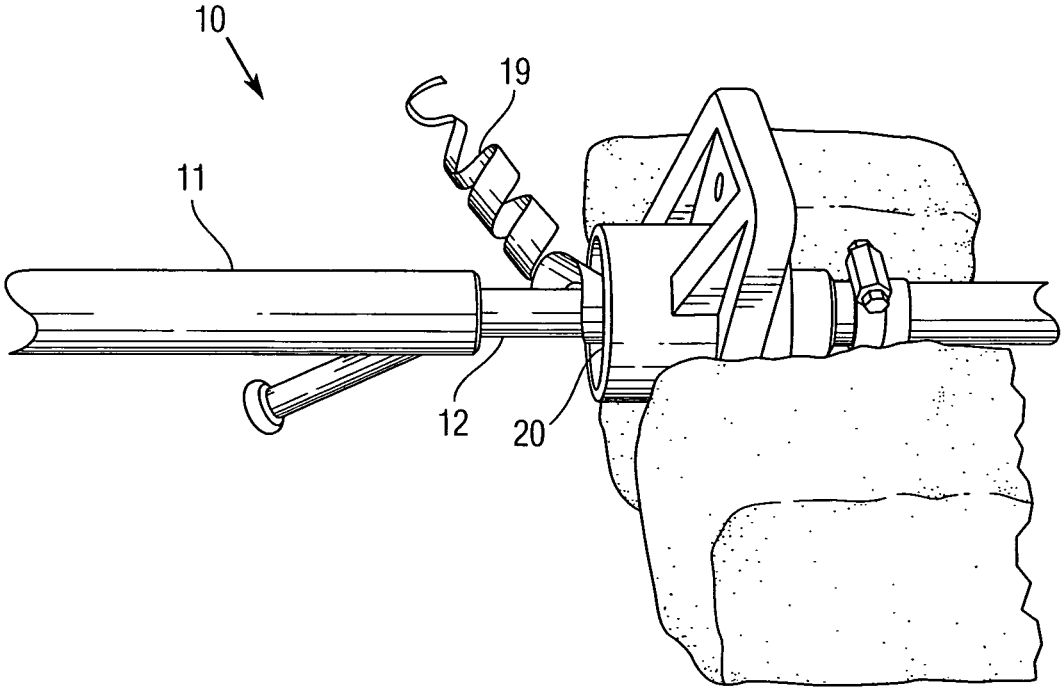
FIG. 7 illustrates the method of the present invention in which an embodiment of the invention cuts and automatically removes the waste sheathing in a spiral fashion.

FIG. 7 shows the removal of a spiral of waste sheathing 19 as the device 10 is rotated and moves towards the bottom of the stressing anchor 20 wedge pocket.

It should now be apparent that the present device 10 facilitates the stripping of sheathing and removal of the resultant waste of sheathing around a tendon. The device 10 wields a heavier, stronger blade that does not require frequent replacement; and the entire length of the waste sheathing 19 is automatically removed without the requirement of a separate waste sheathing removal step.

Having now fully set forth the preferred embodiments and certain modifications of the concept underlying the present invention, various other embodiments as well as certain variations and modifications thereto may obviously occur to those skilled in the art upon becoming familiar with the underlying concept. It is to be understood, therefore, that the invention may be practiced otherwise than as specifically set forth herein.

We claim:

1. A device for stripping sheathing on an unbonded post-tensioning tendon, comprising:

an elongated tubular body for functioning as a grip, said body comprising a first through bore along a longitudinal axis of said body for passing said tendon;

a cylindrical cutting head concentrically attached to said elongated body, said cutting head having a smaller diameter than said elongate body, said cutting head having a truncated distal end, and having a second through bore continuing uniformly through said cutting head along said longitudinal axis, contiguous with said first through bore, and exiting centrally through said distal end to define an annular face, said cutting head having an inner cylindrical surface defining said second through bore, an outer cylindrical surface, and a crescent notch defined by a secant passing through a first point and a second point radially spaced apart on said cutting head outer surface to define a hanging blade portion at said distal end of said cutting head, said hanging blade portion further comprising, a cutting edge extending substantially radially relative to said longitudinal axis, a blade backside protruding outward beyond the outer surface of said distal end, and a planar cutting face that is radially offset from said longitudinal axis and inclined at a pitch angle of between 45 and 85 degrees relative to said longitudinal axis for cutting said sheathing, whereby when said device is slid over and rotated about said tendon, the device helically cuts said sheathing into a resultant helical waste strip.

2. The device for stripping sheathing on an unbonded post-tensioning tendon according to claim 1, wherein said elongated body is cylindrical.

3. The device for stripping sheathing on an unbonded post-tensioning tendon according to claim 1, wherein said blade is integral with said cutting head.

4. The device for stripping sheathing on an unbonded post-tensioning tendon according to claim 3, wherein said crescent notch extends from said secant first point on said cutting head outer surface to within a range of from 2-5 mm from said secant second point on the outer surface, and said hanging blade portion protrudes radially outward and downward to said longitudinal axis.

* * * * *